US006148959A

United States Patent [19]

Shay

[11] Patent Number: 6,148,959

[45] Date of Patent: Nov. 21, 2000

[54] FLEXIBLE LOW-PROFILE GUARD FOR COVERING AND PROTECTING A CLIMBING GAFF

[76] Inventor: Ron Shay, P.O. Box 1180, Colfax, Calif. 95713

[21] Appl. No.: 09/373,888

[22] Filed: Aug. 12, 1999

[51] Int. Cl.[7] ..... A63B 27/00

[52] U.S. Cl. ..... 182/221; 182/134

[58] Field of Search ..... 182/134, 221

[56] References Cited

U.S. PATENT DOCUMENTS

| | | | |
|---|---|---|---|
| 754,016 | 3/1904 | Schmucker | 182/221 |
| 1,774,615 | 9/1930 | Rose | 182/3 |
| 2,607,522 | 8/1952 | Bennington | 182/221 |
| 2,870,947 | 1/1959 | Hendry | 182/221 |
| 3,640,358 | 2/1972 | Smith | 182/221 |
| 4,282,951 | 8/1981 | Zelins . | |
| 4,938,313 | 7/1990 | Rullo | 182/134 |
| 4,989,693 | 2/1991 | Williams . | |
| 5,080,194 | 1/1992 | Williams . | |

*Primary Examiner*—Alvin Chin-Shue
*Attorney, Agent, or Firm*—Heisler & Associates

[57] ABSTRACT

A guard 10 for protection of the gaff G of a lineman's climbing iron I is provided. The gaff guard 10 includes a vertically-elongate rectangular base member 20 to which are attached three smaller members 30, 40, 50. The members 20, 30, 40, 50 are preferably made of a flexible, tough material such as leather. A horizontally-elongate shank strap 30 is transversely attached to the upper portion of the base member 20 to form a throat 38 sufficient to receive and encircle the shank K of the climbing iron I such that the gaff guard 10 is able to slidably translate along the shank K. A sheath member 40 is attached. to the lower portion of the base member 20 to form a pocket to receive, retain and protect the gaff G of the climbing iron I. An ankle strap 50 is attached to the opposite side of the base member 20 near its bottom edge 23 to form a passageway 56 sufficient to slidably receive the ankle belt A of the climbing iron I. Thus configured, the gaff guard 10 is movably and operatively connected to the climbing iron I as one unitary assembly, allowing the gaff guard 10 to safely and effectively operate in a storage, walking or climbing mode.

7 Claims, 3 Drawing Sheets

FLEXIBLE LOW-PROFILE GUARD FOR COVERING AND PROTECTING A CLIMBING GAFF

FIELD OF THE INVENTION

The present invention relates to covers or guards for sharp instruments. More particularly, this invention relates to flexible low profile guards for protecting the sharp gaff of a lineman's climbing iron when it is not in use.

BACKGROUND OF THE INVENTION

Loggers and linemen use climbing irons to climb up or down trees and wooden utility poles while performing their work. The climbing irons provide an alternative means of ascent when other means, such as ladders, hydraulic lifts or climbing rungs, are not available. In effect, the climbing irons act as two movable steps or rungs that the climber repositions on the pole or tree to move up or down.

In use, individual climbing irons are strapped on the inside of a climber's legs, just below the knee. A rigid horizontal stirrup portion of the climbing iron is positioned under the instep of the climber's boot. The stirrup is secured to the climber's boot with a lower ankle belt. A rigid elongate shank extends upward from the stirrup to lay adjacent the inside of the climber's calf. The shank is secured to the climber's leg just below the knee by an upper knee belt and buckle assembly that wraps about the climber's leg.

A critical feature of any climbing iron is the sharp, three-sided steel blade, known as a gaff, which is affixed to a side of the shank opposite the calf and near the stirrup. The gaff provides the means by which the climbing iron engages the exterior of the object being climbed.

As a climber scales a pole or tree, he thrusts the gaff into the side of the pole to gain purchase. For example, to scale a pole, a climber will first drive the gaff of the climbing iron on one leg into the exterior surface of the pole. Once the gaff is securely implanted, the climber places his entire weight on the stirrup of that climbing iron. He then raises his other leg to implant the second gaff at an elevation higher than that of the first gaff. This process is repeated to incrementally move up the pole and reversed to descend.

The climber is also typically aided by a waist rope attached to a climbing belt securely fastened about the climber's midsection. The waist rope is long enough to wrap about the exterior surface of the object being climbed to provide the climber with an additional means of engaging the exterior of the wooden object.

The climber's safety is primarily dependent on the how well the gaff of his climbing iron penetrates and remains implanted in the side of the object being climbed. If a gaff fails to adequately penetrate the side of the object, the climber can lose his purchase and fall. The descent could cause serious physical injury or even death. The sharper the gaff, the better its penetration into the object being climbed. Consequently, the maintenance of an exceptionally sharp gaff is essential to the climber's safety. Correspondingly, this same exceptionally sharp gaff can pose a danger to both the climber or others nearby when not being used for climbing. Hence, protection of the gaff to both retain sharpness for climbing and to prevent inadvertent injury while not being used for climbing is of paramount importance.

Various forms of protective covers or guards for the gaff on a climbing iron are taught in the prior art. Williams (U.S. Pat. Nos. 4,989,693 and 5,080,194) teaches a pivoting gaff guard. This guard includes movable components that could be damaged during use. The guard includes a conical socket to cover the gaff point that is held in place by tension in a spring-loaded member. When the guard is not in use, it pivots upward to lay against the inside of a climber's leg next to the shank. The guard is attached to the shank of the climbing iron using a clamp and screw assembly.

The Williams gaff guard has an inward lateral profile that can interfere with a climber's ability to reliably thrust the gaff into the side of a wooden pole. In addition, the Williams device poses a threat of entanglement. When placed in its stowed position, with the socket swiveled upward toward the top of the climbing iron shank, a cavity or gap is created between the conical socket of the gaff cover and the shank of the iron. This gap could potentially engage protuberances, wires or other items encountered during the course of a climb up a tree, telephone pole or power pole.

Smith (U.S. Pat. No. 3,640,358) teaches a different type of gaff guard where the gaff cover is completely removed from the climbing iron when not in use. Smith's guard requires that a fastener portion be clamped to the shank of the climbing iron. A conical protector is held in place over the point of the gaff by a non-resilient strap which connects by snapping to the fastener portion.

Smith's gaff guard is simpler than Williams', but has other disadvantages. First, the strap which holds the conical protector in place on the gaff could become disconnected from the fastener portion by snaring on a branch or other protuberance. Since Smith's guard does not provide any means to secure the strap and conical protector to the climbing iron once unsnapped, the strap and conical protector would likely be lost. The climber would have to obtain a replacement.

Additionally, Smith emphasizes the advantages of using a non-resilient strap as the means to retain the conical protector on the point of the gaff. However, a non-resilient strap requires that the fastener portion clamped to the shank be adjusted just right so that the conical protector is neither too loose on the tip of the gaff nor too tight such that the fastener might tend to become unsnapped.

Accordingly, a need exists for a simple and reliable gaff guard which is unlikely to be snared during use, can be used on any climbing iron, remains connected to the climbing iron when removed from the gaff to avoid loss, and is readily adjustable.

SUMMARY OF THE INVENTION

The present invention provides a safe, simple and effective means to cover and guard the gaff of a climbing iron to prevent dulling of the gaff or injury to others while the climbing iron is not being used to climb a wooden pole or tree.

The present invention is preferably comprised of four generally rectangular pieces of tough, flexible material. The four pieces are assembled to form a simple unitary gaff guard that can fit any climbing iron.

A larger base member serves as a vertically elongate foundation for attachment of three smaller pieces of material. With the guard installed on a climbing iron, the base member is oriented longitudinally parallel and adjacent the vertical shank.

A horizontally elongate shank strap is joined along its two ends to the upper portion of the the base member to form a collar whose throat is sufficient to accommodate the circumference of the shank of the climbing iron. The collar encircles the shank to slidably connect the gaff guard to the climbing iron.

A trapezoidally-shaped sheath member is joined along three edges to the lower portion of the base member on the same side as the shank strap. The longest upper edge is open. The sheath member forms a pocket with the base member establishing a cavity of sufficient size to receive, retain and protect the gaff of the climbing iron.

A vertically-elongate ankle belt member is attached to the other side of the base member opposite the sheath member. The ankle belt member forms a loop with the base member with a passageway sized to slidably receive the ankle belt of the climbing iron. The ankle belt of the climbing iron is passed through the passageway of the loop and used to frictionally engage the guard with the climbing iron to prevent movement of the guard.

The gaff guard of the present invention is used in three different modes: a stored mode, a walking mode and a climbing mode. All three modes are readily available such that minimal manipulation of the gaff guard is required.

The guard is installed on the climbing iron by first sliding the shank collar formed by the shank strap and the base member over the top of the shank and down till the bottom of the guard is near the stirrup of the climbing iron. The ankle belt of the climbing iron is then passed through the passageway of the loop formed between the ankle belt strap and the base member. Thus connected to the climbing iron, each of the three operative modes may be established.

In a stored mode, with the climbing iron removed from the climber's leg, the gaff guard is manipulated to enclose the gaff of the climbing iron in the cavity of the pocket formed by the sheath member and the base member. The ankle belt of the climbing iron is then wrapped at least two times about the shank, then cinched and buckled to frictionally engage the guard with the shank and retain the gaff within the pocket cavity.

In a climbing mode, with the climbing iron firmly in place on a climber's lower leg, the guard is pulled downward to withdraw the gaff from the pocket cavity. The guard is then translated vertically up the shank till the entire gaff is exposed.

In a walking mode, when the climber has descended and wishes to protect the gaff from damage without removing the climbing iron, the belt is loosened and the guard is pulled downward till the open end of the sheath is below the tip of the gaff. The guard is then pulled up to envelope the gaff in the pocket cavity.

OBJECTS OF THE INVENTION

Accordingly, it is a primary object of the present invention to provide a gaff guard that protects the gaff from dulling so that a climber's safety is maximized.

Another object of the present invention is to provide a gaff guard to prevent injury to the climber or others from inadvertently impacting an exposed gaff while not in use.

Another object of the present invention is to provide a gaff guard that requires minimal manipulation for ease of use.

Another object of the present invention is to provide a gaff guard whose components are integral to form a unitary assembly.

Another object of the present invention is to provide a gaff guard that requires only simple vertical translation to be removed or installed on the gaff of a climbing iron.

Another object of the present invention is to provide a gaff guard with a low installed profile to avoid interference with use of the climbing irons while climbing.

Another object of the present invention is to provide a gaff guard which does not require additional tools for installation on the shank of the climbing iron.

Another object of the present invention is to provide a gaff guard that is operatively connected to a climbing iron in such a manner that it will not be lost when disengaged from covering the gaff.

Another object of the present invention is to provide a gaff guard that can be secured in place by existing components of the climbing iron.

Another object of the present invention is to provide a gaff guard of simple and reliable manufacture from commonly available materials.

Other further objects of the present invention will become apparent from a careful reading of the included drawing figures, the claims and detailed description of the invention.

DESCRIPTION OF THE PREFERRED EMBODIMENT

Figure 1:
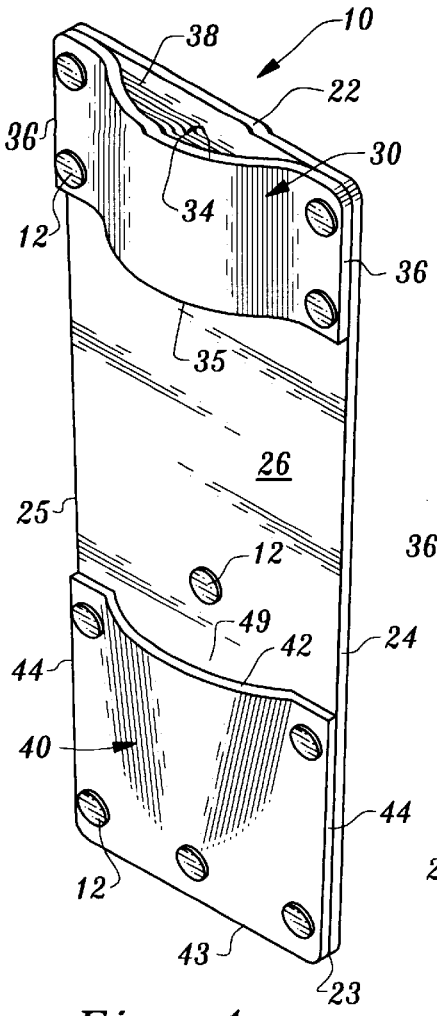
FIG. 1 is a perspective view of the present invention.

Referring to the drawings, wherein like reference numerals represent like parts throughout the various drawing figures, reference numeral 10 is directed to a guard for protecting and covering the gaff G of a climbing iron I. The gaff guard 10 is comprised of a base member 20 and three generally rectangular pieces of material 30, 40, 50. The three pieces of material 30, 40, 50 are joined to the base member 20 to form a single unitary assembly which safely and conveniently integrates with the climbing iron I for use in a storage mode, a climbing mode or a walking mode.

Figure 4:
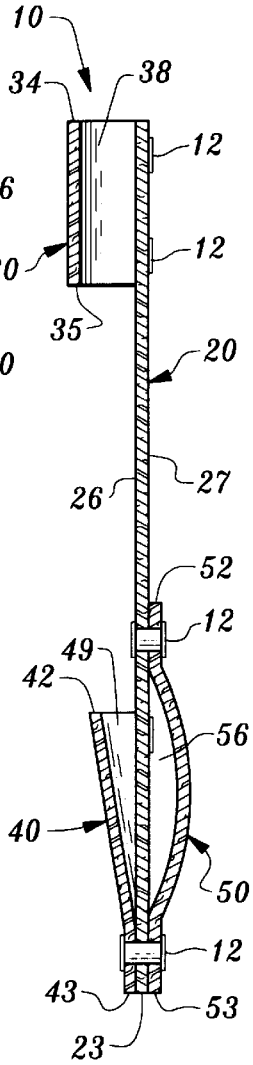
FIG. 4 is a side elevation cross-sectional view of the present invention taken along line 4–4 of FIG. 3.

In essence, and with particular reference to FIGS. 1 and 4, the basic details of the present invention are described. The gaff guard 10 includes a vertically-elongate rectangular base member 20. A first piece of material, a smaller rectangular shank strap 30, is attached to an upper portion of the base member 20 to form a collar to slidably connect the guard 10 to a shank K of the climbing iron I. A second piece of material, a sheath member 40, is attached to a lower portion of the base member 20 to form a pocket. The pocket is sized to receive and protect the gaff G of the climbing iron I. A third piece of material, an ankle belt strap 50, is attached to the lower portion of the base member 20 on the side opposite the sheath member 40 to form a loop. An ankle belt A of the climbing iron I is routed through the loop to secure the guard 10 in different locations while the climbing iron I is either stored, being used for climbing, or worn by a climber while walking on the ground.

The climbing iron I (FIGS. 5, 6, 7 and 8) is a J-shaped device whose primary structure includes a horizontally-elongate rigid stirrup S and the vertically-elongate shank K. The stirrup S connects at a lower bend to a lower end of the shank K of the climbing iron I. The shank K extends vertically from one end of the stirrup S to run along and rest adjacent the inside of a calf C of a leg L of the climber. In use, the stirrup S fits under an instep P of a boot B worn by the climber, just in front of a heel H of the climber's boot B. The stirrup S has sufficient longitudinal span to accept and support a sole O of the boot B of the climber when the stirrup S is positioned beneath the instep P of the climber's boot B.

Figure 7:
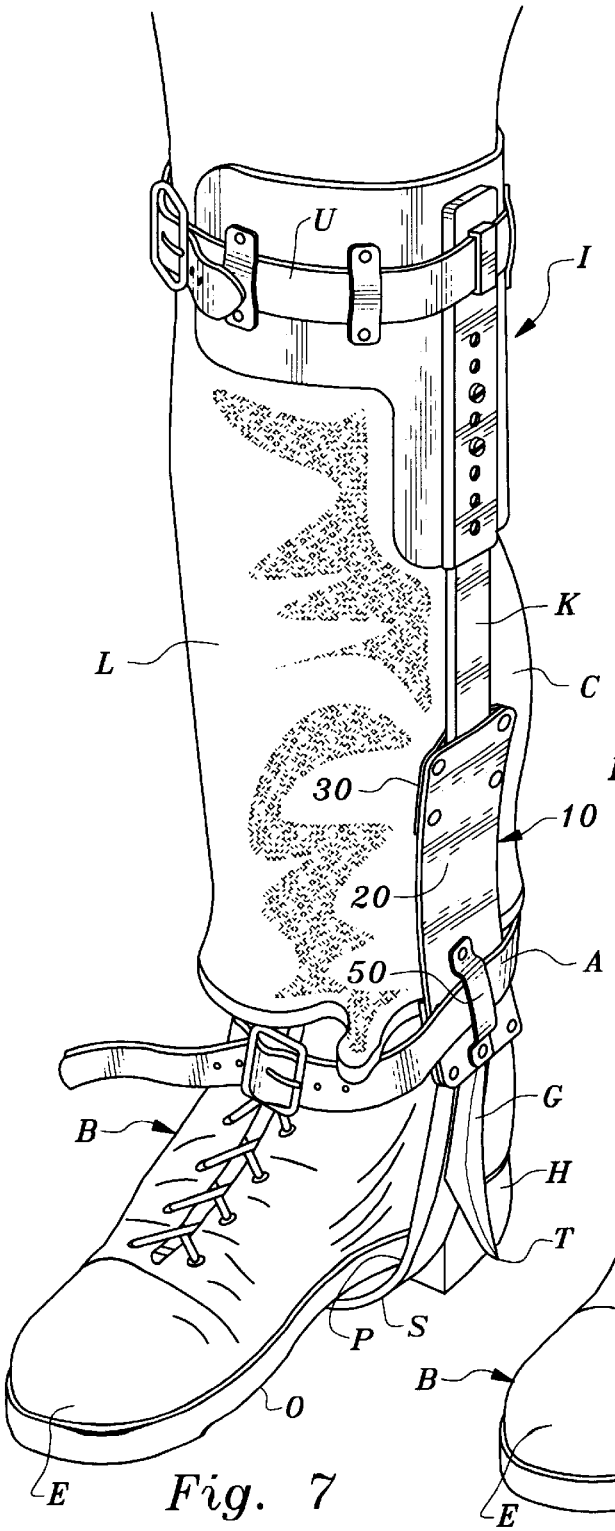
FIG. 7 is a perspective view of the present invention in its climbing mode and attached to a climber's calf, with the guard moved vertically up the shank to expose the gaff.
Figure 8:
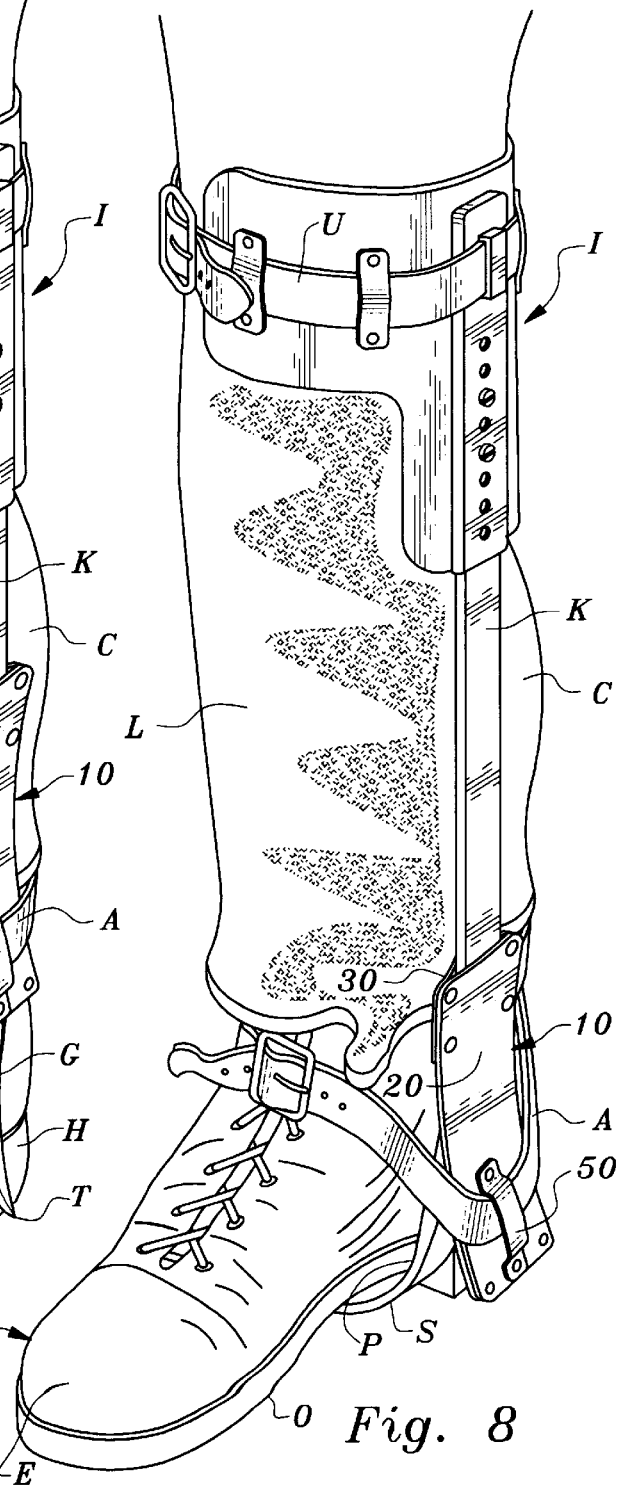
FIG. 8 is that same view shown in FIG. 7, but with the gaff guard positioned in its walking mode.

The lower portion of the climbing iron I, including the stirrup S and the lower portion of the shank K, is secured to the climber's boot B by the ankle belt A (FIGS. 7 and 8). The ankle belt A is connected to the end of the stirrup S furthest from the shank K. The ankle belt A is wrapped about the lower portion of the leg L of the climber, the shank K of the climbing iron I, and the climber's boot B. The ankle belt A is then cinched and buckled to secure the climber's boot B snugly on the stirrup S of the climbing iron I.

The upper portion of the shank K of the climbing iron I is secured about the lower portion of the climber's leg L by an upper knee belt assembly U. The upper knee belt assembly U is connected to the top of the shank K and wrapped about the lower leg L of the climber, then cinched and buckled to snugly secure the upper portion of the shank K to the upper portion of the climber's lower leg L, just below the climber's knee. Secured in this manner, the stirrup S and shank K form a rigid framework to support the climber's lower leg L and provide a means for attachment of the gaff G.

The gaff G of the climbing iron I is affixed to the lower portion of the shank K near the stirrup S (FIG. 7). The gaff G is a three-sided sharp steel blade with a pointed tip T. The gaff G extends downward and slightly inward from the shank K of the climbing iron I, in a direction opposite the stirrup S of the climbing iron I. The gaff G is sufficiently short that the tip T of the gaff G of the climbing iron I does not extend past the sole O of the boot B, when worn by a climber. The gaff G is sufficiently long to adequately penetrate the exterior of a wooden object being climbed, thereby providing secure purchase for the climbing iron I.

More particularly, and with initial reference to FIGS. 1–4, the details of the gaff guard 10 are described. The gaff guard 10 includes a vertically-elongate base member 20. The base member 20 serves as a primary foundation to which other elements of the gaff guard 10 are attached. The base member 20 is a thin, generally rectangular sheet or panel of tough, flexible material, preferably leather. The base member 20 of the guard 10 could also be made of alternative flexible materials, such as ballistic nylon fabric, or of substantially rigid materials, such as plastic, aluminum, or steel.

The base member 20 includes a horizontal top edge 22 and an opposing horizontal and substantially parallel bottom edge 23. The top and bottom edges 22, 24 are the shortest sides of the base member 20 and have sufficient width to span the width of the shank K of the climbing iron I.

A vertically-elongate fore edge 24 of the base member 20 depends perpendicularly from the top edge 22 of the base member 20 to terminate at the bottom edge 23 of the base member 20. The fore edge 24 is oriented nearest the toe E of a climber's boot B when the guard 10 is installed. An opposing vertically-elongate and substantially parallel rear edge 25 of the base member 20 depends perpendicularly from the top edge 22 of the base member 20 to also terminate at the bottom edge 23 of the base member 20. The rear edge 25 is oriented nearest the heel H of a climber's boot B when the guard 10 is installed.

In combination, the edges 22, 23, 24, 25 of the base member 20 define a perimeter of a planar inner face 26 of the base member 20. The inner face 26 is oriented nearest and lies adjacent the shank K when the guard 10 is installed on the climbing iron I. The edges 22, 23, 24, 25 also define a perimeter of an opposing parallel planar outer face 27 of the base member 20. The outer face 27 is oriented furthest from the shank K when the guard 10 is installed on the climbing iron I, facing away from the shank K of the climbing iron I.

An elongate, substantially rectangular shank strap 30 is transversely attached to the inner face 26 of the base member 20 nearest its top edge 22. The shank strap 30 provides one form of a means to movably connect the guard 10 to the shank K of the climbing iron I. Other means include: a two-piece strap attached to the base member 20 that can be wrapped and fastened about the shank K; two lateral incisions within the base member 20 sized to slidably receive the shank K; and, a single integral strap attached to the base member 20 that can be wrapped about the shank K and fastened to the base member 20 to form an encircling collar.

The shank strap 30 is made of flexible, tough material, preferably matching the material forming the base member 20. The shank strap 30 includes a horizontal upper edge 32 and an opposing substantially parallel lower edge 33. The upper and lower edges 32, 33 are the longest sides of the shank strap 30. The upper and lower edges 32, 33 of the shank strap 30 are slightly longer than the width of the top edge 22 of the base member 20.

The shank strap 30 also includes two shorter opposing vertical edges 36 interposed between and perpendicular to the upper and lower edges 32,33. The shank strap 30 is joined crosswise to the base member 20 such that one vertical edge 36 is adjacent and parallel to the fore edge 24 of the base member 20 and the opposing vertical edge 36 is adjacent and parallel to the rear edge 25 of the base member 20. Thus joined, the upper edge 32 of the shank strap 30 is oriented such that it is substantially coplanar with the top edge 22 of the base member 20.

The shank strap 30 is joined to the base member 20 at its four corners by metal pop rivets 12. Other means to join the shank strap 30 to the base member 20 may be used. Such means could include sewn seams, use of adhesives, staples, etc.

Figure 2:
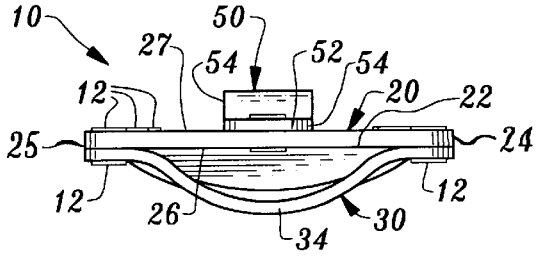
FIG. 2 is a top plan view of the present invention.
Figure 3:
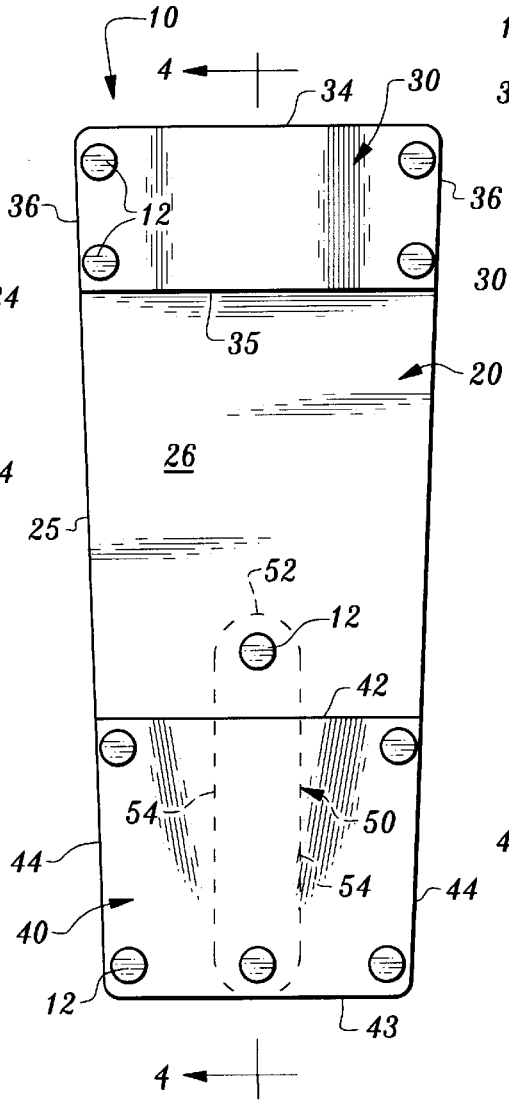
FIG. 3 is a front elevation view of the present invention.

As most clearly shown in FIGS. 1 and 2, the upper and lower edges 34, 35 of the shank strap 30 are slightly longer than the width of the top edge 22 of the base member 20. Consequently, when the vertical edges 36 of the shank strap 30 are uniformly joined along the fore and rear edges 24, 25 of the base member 20, the shank strap 30 necessarily bows outwardly along its length from the inner face 26 of the base member 20. A throat 38 is then formed between the shank strap 30 and the base member 20. The throat 38 has sufficient size to accommodate the lateral circumference of the shank K of the climbing iron I. The throat 38, in combination with the shank strap 30 and the base member 20, provides one form of a means to slidably connect the gaff guard 10 to the shank K of the climbing iron I, acting as a collar that encircles the shank K. A trapezoidally-shaped sheath member 40 is attached to the lower portion of the inner face 26 of the base member 20. The sheath member 40 provides one form of a means to cover the tip T of the gaff G. Other means include: a base member 20 with its bottom portion folded to form a pocket to cover the tip T of the gaff G; a separate one-piece pocket attached to the bottom portion of the base member 20; and a separate plastic cover or receptacle attached to the bottom portion of the base member 20.

The sheath member 40 is preferably made of tough, flexible material similar to that used in the shank strap 30. The sheath member 40 is also preferably joined to the base member 20 with rivets 12. However, other means to join and attach the sheath member 40 to the base member 20 may be used, such as those previously mentioned for joining the shank strap 30 to the base member 20 of the guard 10.

The sheath member 40 includes a horizontal lower end 43 which is joined to and along the bottom edge 23 of the base member 20. The lower end 43 of the sheath member 40 and the bottom edge 23 of the base member 20 are preferably of equal length. Two outer sides 44 of the sheath member 40 extend vertically upward from the horizontal lower end 43 of the sheath member 40. The outer vertical sides 44 of the sheath member 40 are joined to and along the lower portion of the fore and rear edges 24, 25 of the base member 20 such that the outer vertical sides 44 of the sheath member 40 are substantially coplanar with the fore and rear edges 24, 25 of the base member 20. The outer sides 44 of the sheath member 40 have sufficient length to cause the sheath member 40 to cover a substantial portion of the length of the gaff G of the climbing iron I, when the gaff guard 10 is installed in either a storage or walking mode, to prevent the gaff G from becoming damaged or dulled.

A horizontal upper end 42 of the sheath member 40 is connected to the base member 20 at its corners such that it forms a mouth 49. The upper end 42 of the sheath member 40 is longer than the opposing lower end 43 of the sheath member 40. The upper end 42 of the sheath member 40 is also longer than the width of the base member 20 where the sheath member 40 is attached at its corners nearest the upper end 42 to the base member 20. Thus, with two outer sides 44 and the lower end 43 of the sheath member 40 joined peripherally to the lower portion of the base member 20, the longer upper end 42 of the sheath member 40 must flex and bow outwardly away from the inner face 26 of the base member 20. The upper end 42 flexes outward sufficiently to form the mouth 49 whose size is sufficient to receive and retain the breadth of the gaff G of the climbing iron I. The sheath member 40 and the base member 20 thus form a pocket which provides a means to cover the tip T of the gaff G of the climbing iron I. The pocket is sufficiently deep to receive, envelope and protect the length of the gaff G of the climbing iron I. The center rivet 12, joining the lower end 43 of the sheath member 40 to the bottom edge 23 of the base member 20, ensures that the pocket formed by the sheath member 40 and the base member 20 is closed at the bottom. This closure keeps the gaff G in the pocket, preventing the tip T of the gaff G of the climbing iron I from protruding between the sheath member 40 and the base member 20.

A vertically elongate ankle strap 50 is attached to the lower portion of the outer face 27 of the base member 20, opposite the sheath member 40. The ankle strap 50 provides one form of a means to apply force on the covering means to keep the tip T of the gaff G covered. Other force applying means include: use of a resilient base member 20 that is stretched to place the covering means over the tip T of the gaff G; use of a covering means whose inner surface frictionally engages the gaff G to prevent dislodging; and, use of a covering means whose inner surface is lined with magnetic material to magnetically engage the gaff G.

The ankle strap 50 also provides one form of a means to couple the guard 10 to the ankle belt A of the climbing iron. Other means include: two vertical incisions in the lower portion of the base member 20 with sufficient length to slidably receive the ankle belt A; Velcro strips placed on the outer face 27 of the base member 20 to mate with opposing Velcro strips along the inside of the ankle belt A; and, a small male protrusion which extends from the outer face 27 of the base member 20 to mate with and engage one of a plurality of penetrations within the ankle belt A.

The ankle strap 50 is preferably made of tough, flexible material similar to that used for the base member 20, the shank strap 30 and the sheath member 40. The ankle strap 50 is also preferably attached to the base member 20 with metal rivets 12 or other equivalent means.

The ankle strap 50 has a top distal end 52 and an opposing bottom distal end 53. Two elongate and substantially parallel longitudinal sides 54 are interposed between the ends 52, 53 of the ankle strap 50. The bottom distal end 53 of the ankle strap 50 is attached to the outer face 27 of the base member 20 adjacent the bottom edge 23 of the base member 20, preferably near the approximate midpoint of the width of the base member 20. The top distal end 52 of the ankle strap 50 is attached to the outer face 27 of the base member 20 at a point directly above that of the attached bottom distal end 23.

Figures 5, 6:
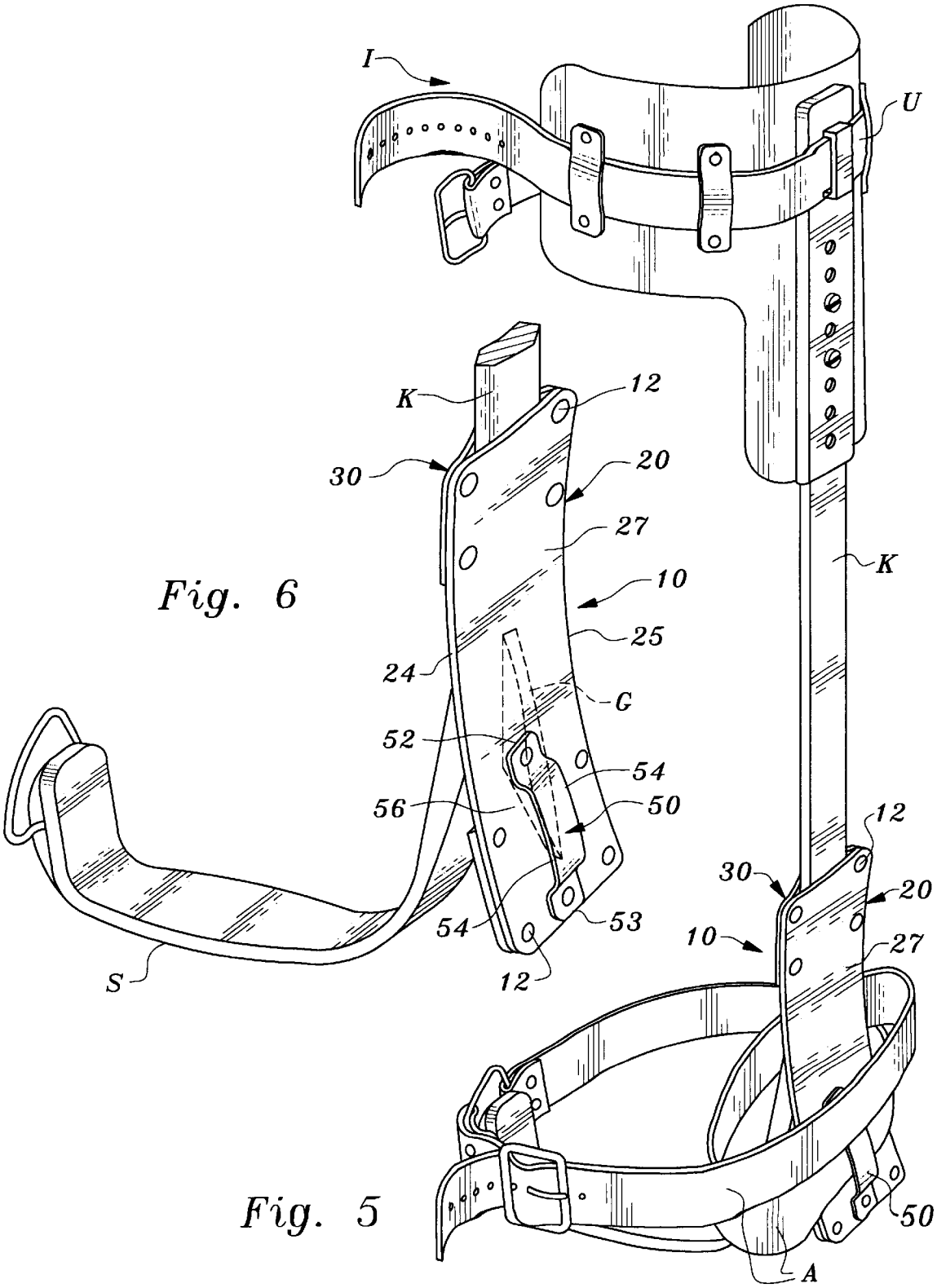
FIG. 5 is a perspective view of the present invention in its stored mode, installed or a climbing iron, illustrating the manner in which the stirrup belt of the climbing iron is routed through the ankle loop of the guard, with the guard enveloping the gaff.
FIG. 6 is a partial perspective view of the present invention, illustrating its position when placed in either a stored mode or walking mode, with the gaff of the climbing iron fully enveloped by the guard.

The distance between the two points on the base member 20 where the top distal end 52 and the bottom distal end 53 of the ankle strap 50 are attached is shorter than the length of the ankle strap 50. Consequently, the ankle strap 50 flexes along its length to bow outwardly away from the outer face 27 of the base member 20. Thus bowed, the ankle strap 50 and the base member 20 form an open passageway 56. The passageway 56 is sufficient in size to slidably receive the ankle belt A of the climbing iron I, such that the ankle belt A may slidably translate through the passageway 56 (FIG. 5). The passageway 56, in combination with the ankle strap 50 and the base member 20, forms a loop to encircle and retain the ankle belt A of the climbing iron I when the gaff guard 10 is installed. The lower rivet 12 simultaneously secures the bottom distal end 53 of the ankle strap 50 and the lower end 43 of the sheath member 40 to the base member 20. This rivet 12 also serves as the previously identified center rivet 12 to close the bottom of the pocket formed between the sheath member 40 and the base member 50.

In use and operation, the gaff guard 10 of the present invention must first be installed on the climbing iron I. To install the gaff guard 10, the upper knee belt assembly U (FIG. 5) of the climbing iron I will likely need to be removed from the top of the shank K. The shank K is then passed through the throat 38 formed between the shank strap 30 and the base member 20 to slidably connect the gaff guard 10 to the shank K of the climbing iron I.

If the upper knee belt assembly U cannot be easily removed from the shank K of the climbing iron I to allow the described embodiment of the gaff guard 10 to be slid onto the shank K, an alternative embodiment of the present invention would be appropriate. An alternative embodiment could include a shank strap 30 composed of two pieces, rather than one, which are attached to the base member 20. The two separate pieces of the shank strap 30 could then be wrapped about the shank K and joined to slidably receive and encircle the shank K, eliminating the need to remove the upper knee belt assembly U. Various means could be used to join the two ends of the shank strap 30, such as velcro fasteners, snap fasteners, buckles or laces.

Once the shank K is engaged and encircled within the throat 38 formed between the shank strap 30 and the base member 20, the gaff guard 10 is able to slidably translate along the shank K. The gaff guard 10 slidably translates along the shank K of the climbing iron I to allow the gaff guard 10 to be re-positioned as required for various modes of operation, as discussed below. The gaff guard 10 must be positioned on the shank K such that the inner face 26 of the base member 20 rests adjacent the exposed side of the shank K furthest from the leg L of the climber. Thus oriented, the gaff guard 10 may be lowered along the shank K until the ankle strap 50 of the gaff guard 10 is positioned near the stirrup S of the climbing iron I. The ankle belt A of the climbing iron I may then be routed through the passageway 56 formed between the ankle strap 50 and the base member 20 of the gaff guard 10.

From this position, with the shank K and the ankle belt A of the climbing iron I captured by the shank strap 30 and the ankle strap 50 of the gaff guard 10, respectively, the gaff guard 10 may be manipulated between two functional positions. In one position, the gaff guard 10 is positioned to cover and envelop the gaff G of the climbing iron I (FIGS. 5, 6 and 8). In the other position (FIG. 7), the gaff guard 10 is removed from the gaff G and slid up the shank K of the climbing iron I so the gaff G of the climbing iron I is fully exposed and may be used in scaling a wooden object.

The gaff guard 10 is operable in three alternative modes: a stored mode, a walking mode and a climbing mode. In a stored mode (FIG. 5), the climbing iron I is removed from the leg of the climber for storage. In the walking mode (FIG. 8) and climbing mode (FIG. 7), the climbing iron is installed on the leg of the climber. The stored mode of operation is discussed first.

As most clearly shown in FIGS. 5 and 6, in its stored mode, the gaff guard 10 is positioned on the shank K of the climbing iron I with the gaff G inserted into the mouth 49 formed between the sheath member 40 and the base member 20, such that the gaff G is substantially enveloped within the pocket formed by the sheath member 40 and base member 20 of the gaff guard 10. The ankle belt A of the climbing iron is routed through the passageway 56 between the ankle strap 50 and the base member 20. The ankle belt A of the climbing iron I is wrapped about the shank K of the climbing iron I a sufficient number of times to cause the ankle belt A, when buckled, to secure and frictionally engage the inner face 26 of the base member 20 of the gaff guard 10 against the shank K of the climbing iron I. Thus secured, the gaff G of the climbing iron I is fully protected by the gaff guard 10 and the entire assembly may be placed in storage without concern for damage to the gaff G. Also, the risk of injury resulting from human contact with an exposed gaff G is avoided.

As most clearly shown in FIG. 7, in its climbing mode, the gaff guard 10 no longer encloses the gaff G between the sheath member 40 and the base member 20 of the gaff guard 10. The gaff G has been withdrawn from the mouth 49 the guard 10 has been moved vertically up the shank K of the climbing iron I to fully expose the gaff G. The gaff guard 10 is likewise retained in this elevated position by the frictional engagement created by the ankle belt A secured about the shank K of the climbing iron I and the boot B of the climber. By placing the ankle strap 50 near the bottom edge 23 of the base member 20, the guard 10 is held up away from the gaff G when the belt A is tight in a substantially horizontal functional climbing orientation.

As most clearly shown in FIG. 8, in its walking mode, with the climbing iron I still secured to the leg L and boot B of the climber, the gaff guard 10 is positioned over the gaff G such that the sheath member 40 and base member 20 of the gaff guard 10 substantially envelop the gaff G of the climbing iron I. A climber repositions the gaff guard 10 from its climbing mode to its walking mode by first pulling the bottom edge 23 of the base member 20 of the gaff guard 10 downward toward the stirrup S of the climbing iron I. The gaff guard 10 is pulled downward until the upper end 42 of the sheath member 40 has cleared the tip T of the gaff G. The tip T of the gaff G would then be positioned to enter the mouth 49 formed between the bowed upper end 42 of the sheath member 40 and the base member 20. The gaff guard 10 is pulled up along the shank K of the climbing iron I until the gaff G is fully inserted between the sheath member 40 and the base member 20, with the tip T of the gaff G located near the bottom edge 23 of the base member 20. The gaff guard 10 is likewise retained in the protective position by the frictional engagement created by the ankle belt A secured about the shank K of the climbing iron I and the boot B of the climber.

The frictional engagement between the inner face 26 of the base member 20 and the shank K of the climbing iron I, created by the tension within the buckled ankle belt A, is sufficient to maintain the gaff guard 10 in either its walking or climbing mode, while still allowing the gaff guard 10 to be manually translated between either position with the ankle belt A still attached and secured. In some instances, the ankle belt A may become too tight during use to allow the climber to easily manipulate the gaff guard 10 between the climbing and walking modes. In those instances, the climber may need to unbuckle and slightly loosen the ankle belt A to slide the gaff guard 10 up or down the shank K of the climbing iron I.

While placed in either the climbing mode or the walking mode (FIGS. 7 and 8, respectively), the gaff guard 10 presents a minimal lateral profile which avoids any interference with the climber's ability to thrust and engage the gaff G in the wooden exterior of an object being climbed. Additionally, the minimal lateral profile of the gaff guard 10 reduces the possibility that the guard might become snared while in use, creating a safety hazard for the climber. Further, the novel form of translatable attachment of the gaff guard 10 to the shank K of the climbing iron I allows the gaff guard 10 of the present invention to be used in the three modes of storage, walking or climbing while the guard 10 remains slidably and operatively connected to the climbing iron I. Thus connected, the gaff guard 10 cannot be dislodged from the climbing iron I and inadvertently lost.

This disclosure is provided to reveal a preferred embodiment of the invention and a best mode for practicing the invention. Having thus described the invention in this way, it should be apparent that various different modifications can be made to the preferred embodiment without departing from the scope and fair meaning of this disclosure.

What is claimed is:

1. A combination lineman's climbing iron and a guard for covering a gaff of the climbing iron, the combination comprising:

the climbing iron having a vertically elongate shank orientable parallel to and adjacent a calf of the lineman, the shank supporting the gaff near a lower bend of the shank, the shank extending horizontally from the lower bend for supporting the foot of the lineman and having a flexible ankle belt attached to an end of the shank;

the guard including:

a base member;

means to cover a tip of the gaff;

said means to cover affixed to said base member;

means to apply force on said means to cover sufficient to keep said means to cover over said gaff, said means to apply force on said means to cover including a loop extending from said base member of said guard, said loop having upper and lower ends spaced apart vertically at least as much as a width of the ankle belt, such that said loop can slidably receive the ankle belt of the climbing iron through a passageway formed by said loop; and means to movably connect said guard to the shank of the climbing iron.

2. The guard of claim 1 wherein said force of said means to apply force includes frictional engagement of said base member with the shank of the climbing iron, said frictional engagement provided by tension within the ankle belt of the climbing iron resulting from the cinching of the ankle belt about the shank of the climbing iron and said base member, sufficiently to retain said means to cover in place.

3. The combination of claim 1 wherein said loop is located closer to a bottom edge of said base member than to a top edge of said base member.

4. A combination lineman's climbing iron and a guard for covering a gaff of the climbing iron, the combination comprising:

the climbing iron having a vertically elongate shank orientable parallel to and adjacent a calf of the lineman, the shank supporting the gaff near a lower bend of the shank, the shank extending horizontally from the lower bend beneath the foot of the lineman and having a flexible ankle belt attached to an end of the shank;

the guard including:

a base member;

said base member oriented adjacent the surface of the shank of the climbing iron and slidably attached to the shank of the climbing iron;

a sheath member;

said sheath member affixed to an inner face of said base member;

said sheath member and said base member forming a pocket;

said pocket having sufficient size to accommodate and protect the gaff of the climbing iron, wherein said loop is located on a surface of said base member opposite a side upon which said means to cover is located, said base member comprises a first piece of material, and said loop is formed by joining a second piece of material to said first piece of material, said second piece of material joined to said base member at a top distal end thereof and at a bottom distal end thereof, said means to cover includes a pocket formed by the joining of a third piece of material to said base member along a lower end of said third piece of material and along two outer sides of said third piece of material, said second piece of material is attached with fasteners, including at least one fastener adjacent said top distal end and at least one fastener adjacent said bottom distal end, said fastener at said bottom distal end passing through said bottom distal end, through said base member of said guard, and thorough said lower end of said third piece of material;

a strap;

said strap affixed to an outer face of said base member;

said strap and said base member forming a loop; and said loop slidably receive the ankle belt of the climbing iron through a passageway between said loop and said base member, wherein said loop is located on a surface of said base member opposite a side upon which said means to cover is located, said base member comprises a first piece of material, and said loop is formed by joining a second piece of material to said first piece of material, said second piece of material joined to said base member at a top distal end thereof and at a bottom distal end thereof, said sheath member includes said pocket formed by the joining of a third piece of material to said base member along a lower end of said third piece of material and along two outer sides of said third piece of material, said second piece of material is attached with fasteners, including at least one fastener adjacent said top distal end and at least one fastener adjacent said bottom distal end, said fastener at said bottom distal end passing through said bottom distal end, through said base member of said guard, and thorough said lower end of said third piece of material.

5. The guard of claim 4 wherein said guard includes a shank strap for slidably attaching said base member to the shank;

said shank strap affixed to said inner face of said base member;

said shank strap and said base member forming a collar; and said collar having sufficient size to encircle the shank of the climbing iron to slidably connect said guard to the shank of the climbing iron.

6. The combination of claim 5 wherein said loop is located closer to a bottom edge of said base member than to a top edge of said base member.

7. The combination of claim 5 wherein at least a portion of said loop is located below at least a portion of said sheath member.

* * * * *